US009313582B2

(12) United States Patent
Chao et al.

(10) Patent No.: US 9,313,582 B2
(45) Date of Patent: Apr. 12, 2016

(54) HEARING AID AND METHOD OF ENHANCING SPEECH OUTPUT IN REAL TIME

(71) Applicant: Kuo-Ping Yang, Taipei (TW)

(72) Inventors: Kuan-Li Chao, Taipei (TW); Neo Bob Chih Yung Young, Taipei (TW); Jing-Wei Li, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 524 days.

(21) Appl. No.: 13/833,009

(22) Filed: Mar. 15, 2013

(65) Prior Publication Data

US 2014/0270289 A1 Sep. 18, 2014

(51) Int. Cl.
*H04R 25/00* (2006.01)

(52) U.S. Cl.
CPC ..... *H04R 25/353* (2013.01); *H04R 2225/43* (2013.01)

(58) Field of Classification Search
CPC ..... H04R 25/356; H04R 2225/43; H04R 25/353; H04R 2430/03; H04R 2400/01; H04R 2460/05; H04R 25/502; H04R 25/505; H04R 25/70; G10L 15/02; H03G 9/005
USPC ..... 381/312, 316, 317, 318
See application file for complete search history.

(56) References Cited

U.S. PATENT DOCUMENTS

| | | | | |
|---|---|---|---|---|
| 4,759,071 | A * | 7/1988 | Heide | H04R 25/356 327/552 |
| 8,582,792 | B2 * | 11/2013 | Chao | H04R 25/353 381/312 |
| 8,837,757 | B2 * | 9/2014 | Rung | H04R 25/70 381/23.1 |
| 2004/0175010 | A1 * | 9/2004 | Allegro | H04R 25/353 381/316 |
| 2007/0127748 | A1 * | 6/2007 | Carlile | G10L 21/00 381/312 |

* cited by examiner

*Primary Examiner* — Davetta W Goins
*Assistant Examiner* — Phylesha Dabney
(74) *Attorney, Agent, or Firm* — Bacon & Thomas, PLLC

(57) ABSTRACT

A method for enhancing speech output in real time is used in a hearing aid device. The input speech is divided into multiple audio segments first. Then each audio segment is analyzed for its attribute: high frequency, low frequency, or soundless. Low frequency segments are outputted without undergoing frequency processing. High frequency segments are outputted after undergoing frequency processing. All or some of the soundless segments are deleted without being outputted. The deletion of soundless segments can reduce the delay caused by the frequency processing of the high frequency segments.

12 Claims, 4 Drawing Sheets

HEARING AID AND METHOD OF ENHANCING SPEECH OUTPUT IN REAL TIME

BACKGROUND OF THE INVENTION

1. Field of the Invention

The present invention relates to a hearing aid device for a hearing-impaired listener.

2. Description of the Related Art

Hearing aids have been in use since the early 1900s. The main concept of the hearing aid is to amplify sounds so as to help a hearing-impaired listener to hear, and to make the sound amplification process generate almost no sound delay. Furthermore, if a hearing aid performs frequency processing, generally the processing reduces the sound frequency. For example, U.S. Pat. No. 6,577,739 "Apparatus and methods for proportional audio compression and frequency shifting" discloses a method of compressing a sound signal according to a specific proportion for being provided to a hearing-impaired listener with hearing loss in a specific frequency range. However, this technique involves compressing the overall sound; even though it can perform real-time output, the compression can result in serious sound distortion.

If frequency reduction is performed only on some high-frequency sounds, the distortion will be reduced. However, this technique involves a huge amount of computation, which may delay the output, and therefore it is often inappropriate for real-time speech processing. For example, the applicant filed U.S. patent application Ser. No. 13/064,645 (Taiwan Patent Application Serial No. 099141772), which discloses a method to reduce distortion; however, it still causes an output delay problem.

Therefore, there is a need to provide a hearing aid and a method of enhancing speech output in real time to reduce distortion of the sound output as well as to reduce the delay of the sound output caused by frequency processing or amplification, so as to mitigate and/or obviate the aforementioned problems.

SUMMARY OF THE INVENTION

During the process of performing frequency processing on speech, sometimes a time delay might occur, and such a delay causes asynchronous speech output. Therefore, it is an object of the present invention to provide a method of enhancing speech output in real time.

To achieve the abovementioned object, the present invention comprises the following steps:

dividing an input speech into a plurality of audio segments;

searching for at least two audio segments with attributes different from the plurality of audio segments, including:

a soundless segment, wherein a sound energy of the soundless segment is lower than a sound energy threshold; and a non-soundless segment, where a sound energy of the non-soundless segment is higher than a sound energy threshold, wherein in one embodiment of the present invention, the non-soundless segment is selected from two attributes including a low-frequency attribute and a high-frequency attribute;

and outputting some of the plurality of audio segments, wherein:

all or some of the non-soundless segments undergo frequency processing and then all of the non-soundless segments are outputted, wherein in one embodiment of the present invention, if the attribute of the non-soundless segment is the high-frequency attribute, the frequency processing is necessary, and if the attribute of the non-soundless segment is the low-frequency attribute, no frequency processing is performed; and all or some of the soundless segments are deleted and are not outputted.

According to the abovementioned steps, a delay caused by performing frequency processing on all or some of the non-soundless segments can be reduced or eliminated by deleting all or some of the soundless segments.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
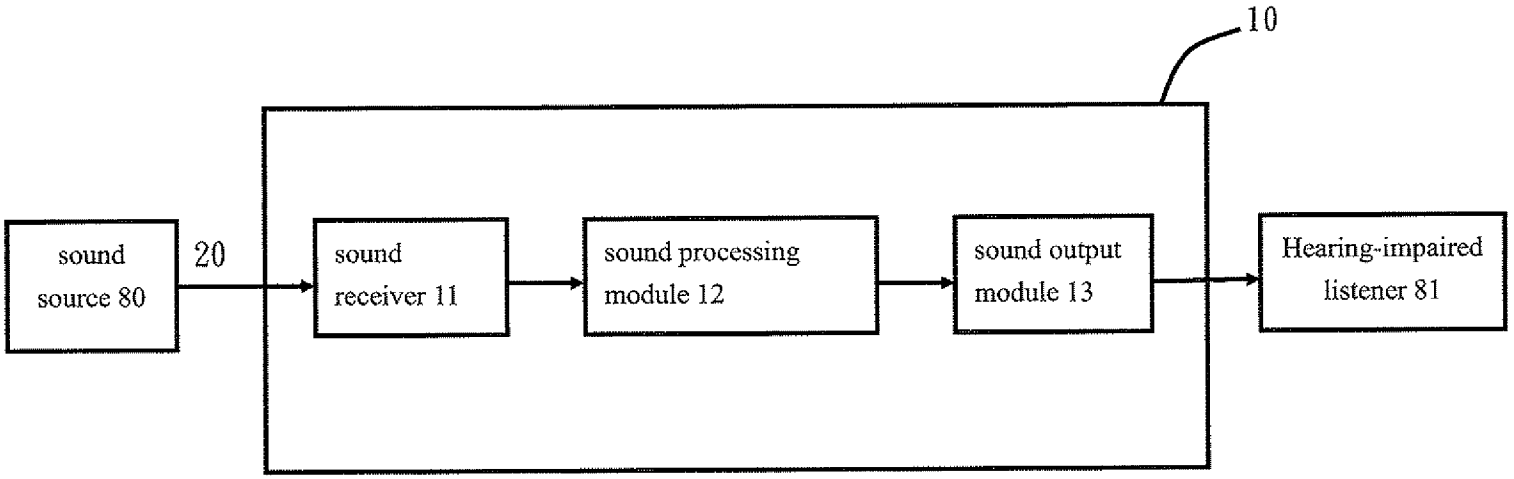
FIG. 1 illustrates a structural drawing of a hearing aid device according to the present invention.

Please refer to FIG. 1, which illustrates a structural drawing of a hearing aid device according to the present invention.

The hearing aid device 10 of the present invention comprises a sound receiver 11, a sound processing module 12, and a sound output module 13. The sound receiver 11 is used for receiving an input speech 20 transmitted from a sound source 80. After the input speech 20 is processed by the sound processing module 12, it can be outputted to a hearing-impaired listener 81 by the sound output module 13. The sound receiver 11 can be a microphone or any equipment capable of receiving sound. The sound output module 13 can include a speaker, an earphone, or any equipment capable of playing audio signals. However, please note that the scope of the present invention is not limited to the abovementioned devices. The sound processing module 12 is generally composed of a sound effect processing chip associated with a control circuit and an amplifier circuit; or it can be composed of a processor and a memory associated with a control circuit and an amplifier circuit. The object of the sound processing module 12 is to perform amplification processing, noise filtering, frequency composition processing, or any other necessary processing on sound signals in order to achieve the object of the present invention. Because the sound processing module 12 can be accomplished by utilizing known hardware associated with new firmware or software, there is no need for further description of the hardware structure of the sound processing module 12. The hearing aid device 10 of the present invention is basically a specialized device with custom-made hardware, or it can be a small computer such as a personal digital assistant (PDA), a PDA phone, a smart phone, or a personal computer. Take a mobile phone as an example; after a processor executes a software program in a memory, the main structure of the sound processing module 12 shown in FIG. 1 can be formed by associating with a sound chip, a microphone and a speaker (either an external device or an earphone). Because the processing speed of a modern mobile phone processor is fast, a mobile phone associated with appropriate software can therefore be used as a hearing aid device.

Figure 2:
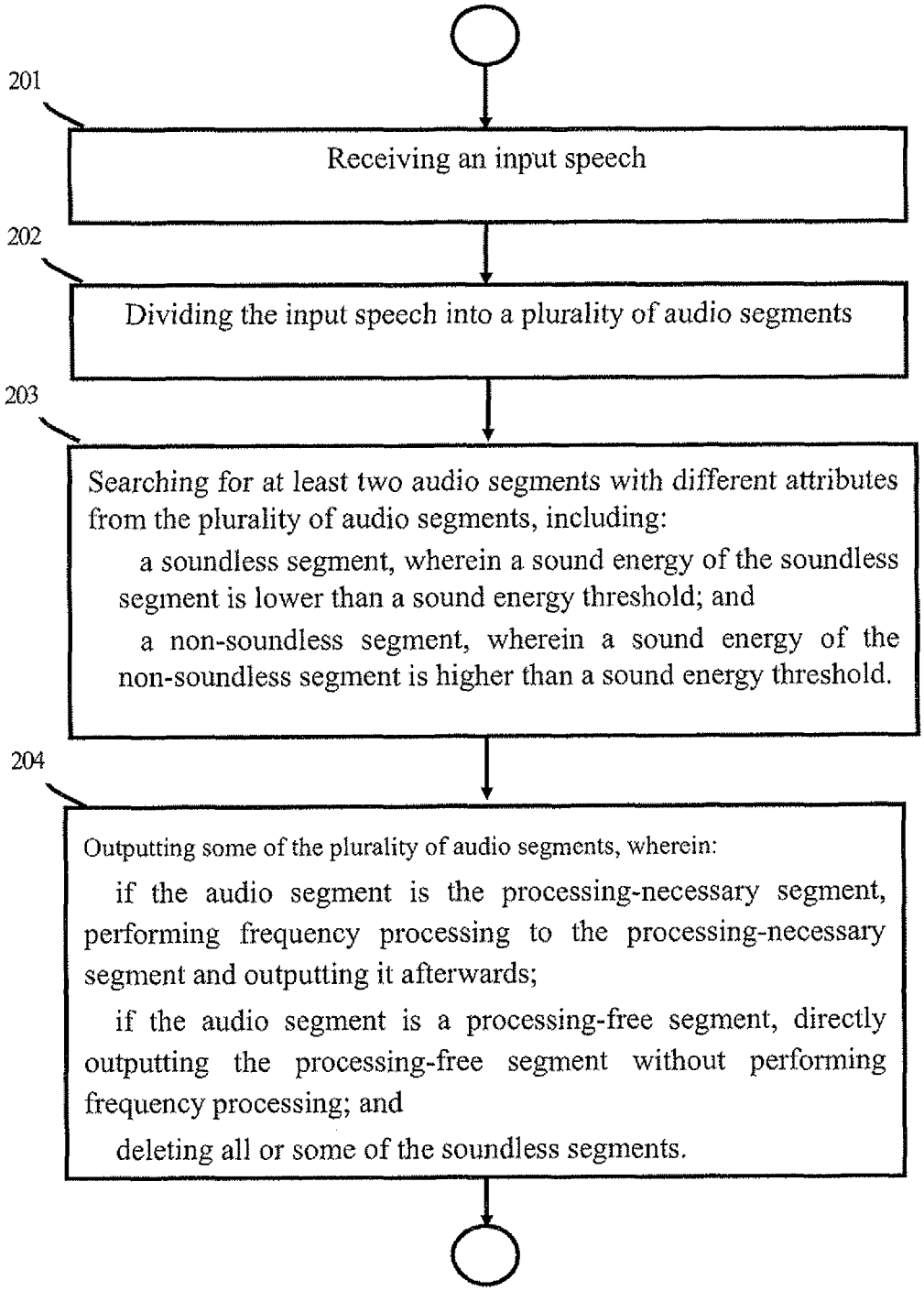
FIG. 2 illustrates a flowchart of a sound processing module according to the present invention.
Figure 3:
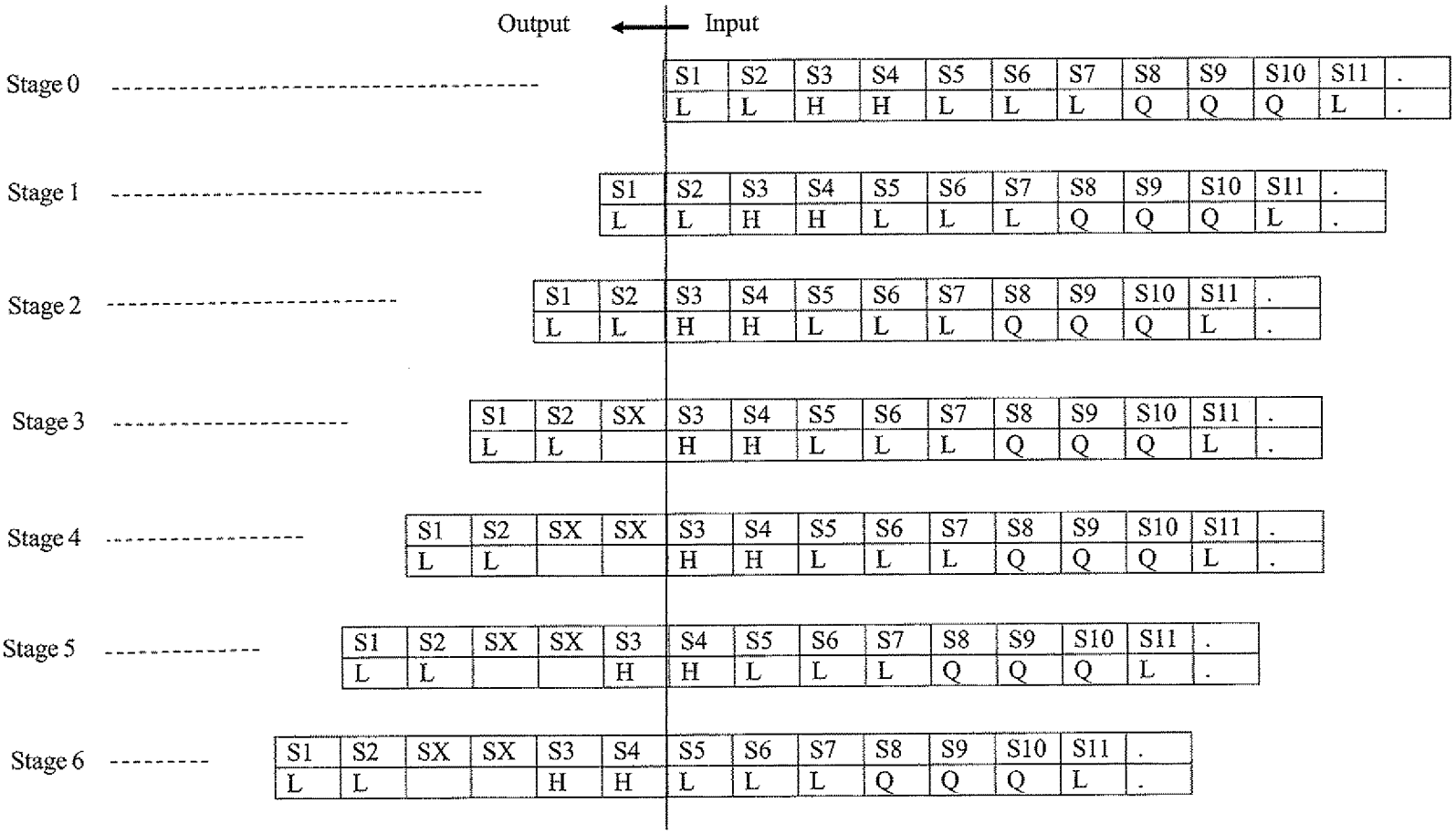
FIG. 3 illustrates a schematic drawing explaining sound processing according to the present invention.
Figure 4:
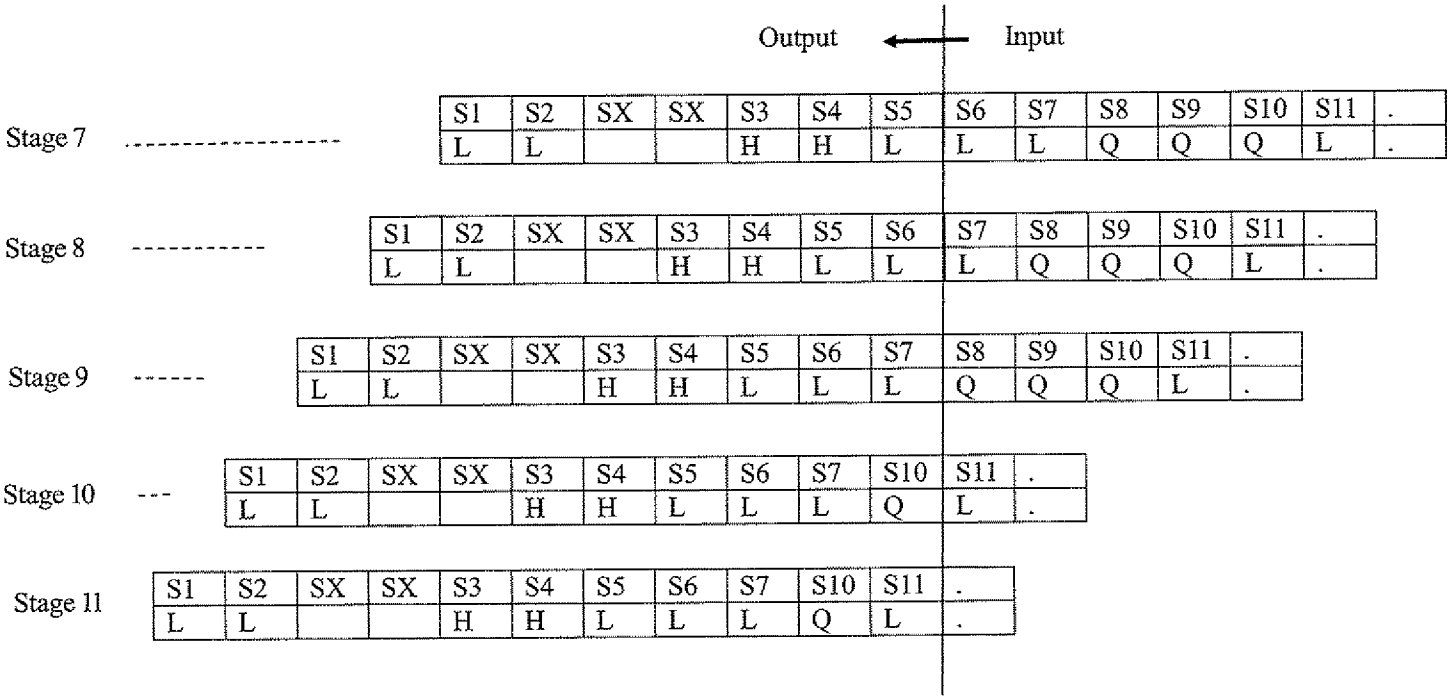
FIG. 4 illustrates a schematic drawing showing sound processing according to the present invention.

Now please refer to FIG. 2, which illustrates a flowchart of the sound processing module according to the present invention. Please also refer to FIG. 3 and FIG. 4, which illustrate schematic drawings explaining sound processing according to the present invention, wherein FIG. 3 and FIG. 4 show stages 0~11 in a step-by-step mode for elaborating the key points of the present invention.

Step 201: Receiving an input speech 20.

This step is accomplished by the sound receiver 11, which receives the input speech 20 transmitted from the sound source 80.

Step 202: Dividing the input speech 20 into a plurality of audio segments.

Please refer to "Stage 0" in FIG. 3. For ease of explanation, the divided input speech 20 is marked as audio segments S1, S2, S3, and so on according to the time sequence, wherein the attribute of each audio segment (S1~S11) is marked as "L", "H" or "Q". For example, the audio segment S1 is marked as "L", which means the sound of the audio segment S1 is prone to low-frequency sound; the audio segment S3 is marked as "H", meaning the sound of the audio segment S3 is prone to high-frequency sound; and the audio segment S8 is marked as "Q", meaning the sound of the audio segment S8 is soundless (such as lower than 15 decibels).

The time length of each audio segment is preferably between 0.0001 and 0.1 second. According to an experiment using an Apple iPhone 4 as the hearing aid device (by means of executing, on the Apple iPhone 4, a software program made according to the present invention), a positive outcome is obtained when the time length of each audio segment is between about 0.0001 and 0.1 second.

Step 203:

Searching for at least two audio segments with different attributes from the plurality of audio segments, including:

a soundless segment, wherein a sound energy of the soundless segment is less than a sound energy threshold; and a non-soundless segment, wherein a sound energy of the non-soundless segment is higher than a sound energy threshold.

The sound processing module 12 divides the input speech 20 into a plurality of audio segments and also determines the attribute "L", "H" or "Q" of each audio segment. It is very easy to determine whether an audio segment is a soundless segment (i.e., "Q"). Basically, a sound energy threshold (such as 15 decibels) is given; any audio segment with sound energy less than the given sound energy threshold will be determined to be a soundless segment, and any audio segment with sound energy higher than the threshold will be determined to be a non-soundless segment. In this embodiment, the non-soundless segments are divided into at least two attributes, respectively marked as "L" (low-frequency segment) or "H" (high-frequency segment).

As for the process of determining whether the audio segment is prone to a high-frequency segment or a low-frequency segment, the determination is primarily performed according to the condition of the hearing-impaired listener. Generally, the frequency of human speech communication is between 20 Hz and 16,000 Hz. However, it is difficult for general hearing-impaired listeners to hear frequencies higher than 3,000 Hz or 4,000 Hz. The greater the severity of impairment of the hearing-impaired listener is, the greater the loss of sensitivity to the high-frequency range is. Therefore, whether the attribute of each audio segment is marked as "L" or "H" is determined according to the hearing-impaired listener. There are various known techniques of determining whether the audio segment should belong to "L" or "H". For example, one technique analyzes whether each audio segment has a sound higher than a certain hertz (such as 3000 Hz); however, this simple technique is somewhat imprecise. The applicant has previously filed U.S. patent application Ser. No. 13/064,645 (Taiwan Patent Application Serial No. 099141772), which discloses a technique for determining high-frequency or low-frequency energy. Below please find some examples of possible determination:

If at most 30% of the sound energy of the audio segment is under 1,000 Hz and at least 70% of the sound energy of the audio segment is over 2500 Hz, the attribute of the audio segment is marked as high-frequency "H"; otherwise, the attribute of the audio segment is marked as low-frequency "L".

If at least 30% of the sound energy of the audio segment is under 1,000 Hz, the attribute of the audio segment is marked as low-frequency "L"; otherwise, the attribute of the audio segment is marked as high-frequency "H".

If at most 30% of the sound energy of the audio segment is under 1000 Hz, the attribute of the audio segment is marked as high-frequency "H"; otherwise, the attribute of the audio segment is marked as low-frequency "L".

If at least 70% of the sound energy of the audio segment is over 2500 Hz, the attribute of the audio segment is marked as high-frequency "H"; otherwise, the attribute of the audio segment is marked as low-frequency "L".

Basically, right after dividing an audio segment, the sound processing module 12 can immediately determine the attribute of the audio segment. Alternatively, the sound processing module 12 can divide, for example, five audio segments at first and then determine the attribute of each audio segment by means of batch processing.

Step 204:

Outputting some of the plurality of audio segments, wherein:

all or some of the non-soundless segments undergo frequency processing and then all of the non-soundless segments are outputted; and all or some of the soundless segments are deleted and are not outputted.

In this embodiment, the present invention performs frequency processing on non-soundless segments with attributes marked as "H" (high-frequency sound), and does not perform frequency processing on non-soundless segments with attributes marked as "L" (low-frequency sound). Because it is difficult for the hearing-impaired listener to hear high-frequency sound, the audio segments with attributes of "H" are classified as "processing-necessary segments", and the audio segments with attributes of "L" are classified as "processing-free segments". In order to enable the hearing-impaired listener to hear the high-frequency sound, the frequency processing reduces the sound frequency, which is performed by means of methods such as frequency compression or frequency shifting. Because the technique of frequency compression or frequency shifting is well known to those skilled in the art, there is no need for further description. Please note that in order to enable the hearing-impaired listener to hear the high-frequency sound, a conventional technique is to reduce the sound frequency of the entire sound section, which results in serious sound distortion. U.S. patent application Ser. No. 13/064,645 (Taiwan Patent Application Serial No. 099141772) is disclosed to improve such a problem. However, the technique of determining whether the sound is high-frequency or low-frequency first and then determining whether to perform frequency processing to the high-frequency sound will cause a delay. Therefore, the technique disclosed in U.S. patent application Ser. No. 13/064,645 (Taiwan Patent Application Serial No. 099141772) will cause an obvious delay problem when outputting speech in real time, and thus the present invention is provided to improve this problem.

Please refer to FIG. 3 and FIG. 4 regarding the description of an embodiment according to the present invention.

Stage 0: An initial status. Please refer to the description of step 202 regarding how the audio segment is marked.

Stage 1: The attribute of the first audio segment S1 is marked as low-frequency "L", and therefore the audio segment S1 will be outputted without undergoing frequency processing. Please note that in order to enable the hearing-impaired listener to hear sound, the outputted audio segment undergoes amplification processing (so as to enhance its sound energy).

Stage 2: The attribute of the second audio segment S2 is marked as low-frequency "L", and therefore the audio segment S2 is outputted without undergoing frequency processing.

Stage 3: The attribute of the third audio segment S3 is marked as high-frequency "H", and therefore the frequency processing is performed. Because the frequency processing takes time, it starts to generate a delayed output, wherein the audio segment S3 cannot be outputted in real time. For ease of explanation, an audio segment SX in Stage 3 is used as a virtual output, wherein the audio segment SX is in fact soundless and also represents a delayed time segment.

Stage 4: The attribute of the fourth audio segment S4 is marked as high-frequency "H", and therefore the frequency processing is performed. In this embodiment, it is assumed that the time required for performing frequency processing is equal to the length of two audio segments, that the audio segment S3 still cannot be outputted at this time point, and that the audio segment S4 also cannot be outputted because it is undergoing frequency processing; therefore, another audio segment SX is added to Stage 4 in a similar way.

Stage 5: Because the audio segment S3 is fully processed at this time point, the audio segment S3 is outputted. As shown in the figures, if there is no delay, the audio segment S5 should be outputted in Stage 5. However, because there are two delayed audio segments SX, what is outputted in Stage 5 is the audio segment S3.

Stage 6: Because the audio segment S4 is fully processed at this time point, the audio segment S4 is outputted.

Stage 7: The attribute of the fifth audio segment S5 is marked as low-frequency "L", and therefore the audio segment S5 is outputted without undergoing frequency processing.

Stage 8: The attribute of the sixth audio segment S6 is marked as low-frequency "L", and therefore the audio segment S6 is outputted without undergoing frequency processing.

Stage 9: The attribute of the seventh audio segment S7 is marked as low-frequency "L", and therefore the audio segment S7 is outputted without undergoing frequency processing. As shown in the figures, the delay in Stage 3 is equal to the length of one audio segment (i.e., one audio segment SX), and the delay from Stage 4 to Stage 9 is equal to the length of two audio segments (i.e., two audio segments SX).

Stage 10: the subsequent audio segment S8, audio segment S9, and audio segment S10 are all soundless segments. The present invention deletes all or some of the soundless segments without outputting the soundless segments. In this embodiment, because two audio segments are delayed, the audio segment S8 and the audio segment S9 are not outputted, and only the audio segment S10 is outputted.

Therefore, if there is any delay generated earlier, the present invention can achieve the object of reducing or eliminating the delay by means of not outputting all or some of the soundless segments. For example, if the delay is accumulated with six audio segments, and the subsequent audio segments have four soundless segments, then none of the four soundless segments will be outputted; however, if the subsequent audio segments have eight soundless segments, then six of the soundless segments will not be outputted and two of the soundless segments will be outputted.

Generally speaking, in speech communications, the high-frequency segments are the lowest proportion (often less then 10%), the low-frequency segments are the largest proportion, and the soundless segments greatly outnumber the high-frequency segments. Therefore, if the sound processing module 12 operates at sufficiently high speed, the delay caused by performing frequency processing on the high-frequency segments can be reduced or eliminated by means of deleting some soundless segments.

Stage 11: The attribute of the eleventh audio segment S11 is marked as low-frequency "L", and therefore the audio segment S11 will be outputted without undergoing frequency processing. As shown in the figures, no delay is caused in Stage 11 when the audio segment S11 is outputted.

Please note that in a general hearing aid device, the sound processing module 12 basically performs sound amplification processing and noise reduction processing. Because the abovementioned sound amplification processing and noise reduction processing are not the key point of the present invention, there is no need for further description.

Although the present invention has been explained in relation to its preferred embodiments, it is to be understood that many other possible modifications and variations can be made without departing from the spirit and scope of the invention as hereinafter claimed.

What is claimed is:

1. A method of enhancing speech output in real time, used in a hearing aid device, the method comprising:

receiving an input speech;

dividing the input speech into a plurality of audio segments;

searching for at least two audio segments with different attributes from the plurality of audio segments, including:

a soundless segment, wherein a sound energy of the soundless segment is lower than a sound energy threshold; and a non-soundless segment, wherein a sound energy of the non-soundless segment is higher than a sound energy threshold;

and outputting some of the plurality of audio segments, wherein:

all or some of the non-soundless segments undergo frequency processing and then all of the non-soundless segments are outputted; and all or some of the soundless segments are deleted and are not outputted;

whereby a delay caused by performing frequency processing on all or some of the non-soundless segments can be reduced or eliminated by deleting all or some of the soundless segments;

wherein the non-soundless segment comprises two types of segments, a processing-free segment and a processing-necessary segment if the audio segment is a processing-necessary segment, the processing-necessary segment undergoes frequency processing and is outputted afterwards; and if the audio segment is a processing-free segment, the processing-free segment is outputted without undergoing frequency processing;

wherein the frequency processing is a process of reducing a sound frequency; and wherein the processing-free segment meets the condition of at least 30% of the sound energy is under 1000 Hz.

2. The method of enhancing speech output in real time as claimed in claim 1, wherein the process of reducing the sound frequency is performed by means of frequency compression or frequency shifting.

3. The method of enhancing speech output in real time as claimed in claim 1, wherein the processing-necessary segment meets at least one of the following conditions of:

at most 30% of the sound energy is under 1000 Hz and at least 70% of the sound energy is over 2500 Hz;

at least 70% of the sound energy is over 2500 Hz; or at most 30% of the sound energy is under 1000 Hz.

4. The method of enhancing speech output in real time as claimed in claim 3, wherein a time length of each audio segment is between 0.0001 and 0.1 second.

5. A hearing aid device, comprising:

a sound receiver, used for receiving an input speech;

a sound processing module, electrically connected to the sound receiver, used for:

dividing the input speech into a plurality of audio segments;

searching for at least two audio segments with different attributes from the plurality of audio segments, including:

a soundless segment, wherein a sound energy of the soundless segment is lower than a sound energy threshold; and a non-soundless segment, wherein a sound energy of the non-soundless segment is higher than a sound energy threshold;

performing frequency processing on all or some of the non-soundless segments; and deleting all or some of the soundless segments;

and a sound output module, electrically connected to the sound processing module, used for outputting all or some of the plurality of audio segments after the plurality of audio segments are processed by the sound processing module;

whereby a delay caused by performing frequency processing on all or some of the non-soundless segments can be reduced or eliminated by deleting all or some of the soundless segments;

wherein the non-soundless segment comprises two types of segments, a processing-free segment and a processing-necessary segment if the audio segment is a processing-necessary segment, the processing-necessary segment undergoes frequency processing and is outputted afterwards; and if the audio segment is a processing-free segment, the processing-free segment is outputted without undergoing frequency processing;

wherein the frequency processing is a process of reducing a sound frequency; and wherein the processing-free segment meets the following condition of: including at least 30% of sound energy under 1000 Hz.

6. The hearing aid device as claimed in claim 5, wherein the process of reducing the sound frequency is performed by means of frequency compression or frequency shifting.

7. The hearing aid device as claimed in claim 5, wherein the processing-necessary segment meets at least one of the following conditions of:

at most 30% of the sound energy is under 1000 Hz and at least 70% of the sound energy is over 2500 Hz;

at least 70% of the sound energy is over 2500 Hz; or at most 30% of the sound energy is under 1000 Hz.

8. The hearing aid device as claimed in claim 7, wherein a time length of each audio segment is between 0.0001 and 0.1 second.

9. A method of enhancing speech output in real time, used in a hearing aid device, the method comprising:

receiving an input speech;

dividing the input speech into a plurality of audio segments;

searching for at least two audio segments with different attributes from the plurality of audio segments, including:

a soundless segment, wherein a sound energy of the soundless segment is lower than a sound energy threshold; and a non-soundless segment, wherein a sound energy of the non-soundless segment is higher than a sound energy threshold;

and outputting some of the plurality of audio segments, wherein:

all or some of the non-soundless segments undergo frequency processing and then all of the non-soundless segments are outputted; and all or some of the soundless segments are deleted and are not outputted;

whereby a delay caused by performing frequency processing on all or some of the non-soundless segments can be reduced or eliminated by deleting all or some of the soundless segments;

wherein the non-soundless segment comprises two types of segments, a processing-free segment and a processing-necessary segment; if the audio segment is a processing-necessary segment, the processing-necessary segment undergoes frequency processing and is outputted afterwards; and if the audio segment is a processing-free segment, the processing-free segment is outputted without undergoing frequency processing;

wherein the frequency processing is a process of reducing a sound frequency; and wherein the processing-necessary segment meets at least one of the following conditions of:

at most 30% of the sound energy is under 1000 Hz and at least 70% of the sound energy is over 2500 Hz;

at least 70% of the sound energy is over 2500 Hz; or at most 30% of the sound energy is under 1000 Hz.

10. The method of enhancing speech output in real time as claimed in claim 9, wherein a time length of each audio segment is between 0.0001 and 0.1 second.

11. A hearing aid device, comprising:

a sound receiver, used for receiving an input speech;

a sound processing module, electrically connected to the sound receiver, used for:

dividing the input speech into a plurality of audio segments;

searching for at least two audio segments with different attributes from the plurality of audio segments, including:

a soundless segment, wherein a sound energy of the soundless segment is lower than a sound energy threshold; and a non-soundless segment, wherein a sound energy of the non-soundless segment is higher than a sound energy threshold;

performing frequency processing on all or some of the non-soundless segments; and deleting all or some of the soundless segments;

and a sound output module, electrically connected to the sound processing module, used for outputting all or some of the plurality of audio segments after the plurality of audio segments are processed by the sound processing module;

whereby a delay caused by performing frequency processing on all or some of the non-soundless segments can be reduced or eliminated by deleting all or some of the soundless segments;

wherein the non-soundless segment comprises two types of segments, a processing-free segment and a processing-necessary segment; if the audio segment is a processing-necessary segment, the processing-necessary segment undergoes frequency processing and is outputted afterwards; and if the audio segment is a processing-free segment, the processing-free segment is outputted without undergoing frequency processing;

wherein the frequency processing is a process of reducing a sound frequency; and wherein the processing-necessary segment meets at least one of the following conditions of: at most 30% of the sound energy is under 1000 Hz and at least 70% of the sound energy is over 2500 Hz; at least 70% of the sound energy is over 2500 Hz; or at most 30% of the sound energy is under 1000 Hz.

12. The method of enhancing speech output in real time as claimed in claim 11, wherein a time length of each audio segment is between 0.0001 and 0.1 second.

* * * * *